US011371327B2

(12) United States Patent
McMullen

(10) Patent No.: US 11,371,327 B2
(45) Date of Patent: Jun. 28, 2022

(54) SENSING DURING ARTIFICIAL LIFT

(71) Applicant: Upwing Energy, Inc., Cerritos, CA (US)

(72) Inventor: Patrick McMullen, Villa Park, CA (US)

(73) Assignee: Upwing Energy, Inc., Cerritos, CA (US)

( * ) Notice: Subject to any disclaimer, the term of this patent is extended or adjusted under 35 U.S.C. 154(b) by 46 days.

(21) Appl. No.: 16/920,086

(22) Filed: Jul. 2, 2020

(65) Prior Publication Data

US 2022/0003087 A1 Jan. 6, 2022

(51) Int. Cl.

| | |
|---|---|
| ***E21B 43/12*** | (2006.01) |
| ***E21B 47/13*** | (2012.01) |
| ***E21B 47/14*** | (2006.01) |
| ***E21B 47/008*** | (2012.01) |

(52) U.S. Cl.

CPC ..... *E21B 43/128* (2013.01); *E21B 47/008* (2020.05); *E21B 47/13* (2020.05); *E21B 47/14* (2013.01)

(58) Field of Classification Search

CPC ..... E21B 43/128; E21B 43/121; E21B 47/13; E21B 47/138; E21B 47/14

See application file for complete search history.

(56) References Cited

U.S. PATENT DOCUMENTS

| | | | |
|---|---|---|---|
| 8,102,088 | B2 | 1/2012 | Filatov |
| 8,183,854 | B2 | 5/2012 | Filatov |
| 10,253,606 | B1 | 4/2019 | Artinian et al. |
| 10,280,721 | B1 * | 5/2019 | Artinian ..... E21B 36/001 |
| 10,364,815 | B2 | 7/2019 | Stout et al. |
| 10,370,947 | B1 | 8/2019 | Artinian et al. |
| 10,584,533 | B2 | 3/2020 | McMullen et al. |
| 2014/0126331 | A1 * | 5/2014 | Skinner ..... G01V 11/002 367/82 |
| 2018/0179849 | A1 | 6/2018 | Krishnan et al. |
| 2018/0179861 | A1 | 6/2018 | Artinian |
| 2018/0179867 | A1 | 6/2018 | Artinian |
| 2018/0179868 | A1 | 6/2018 | Andonian et al. |
| 2018/0179870 | A1 | 6/2018 | Artinian |
| 2018/0179871 | A1 | 6/2018 | Artinian et al. |
| 2018/0179873 | A1 | 6/2018 | Artinian et al. |

(Continued)

FOREIGN PATENT DOCUMENTS

| | | |
|---|---|---|
| WO | 2020047078 | 3/2020 |

*Primary Examiner* — Caroline N Butcher
(74) *Attorney, Agent, or Firm* — Fish & Richardson P.C.

(57) ABSTRACT

A system for operating in a wellbore in a subterranean formation is described. The system includes a housing, a rotor, a stator, and a controller. The rotor is within the housing and includes a rotatable shaft, a fluid impeller, and a magnetic field source. The magnetic field source is configured to generate a net magnetic field around an entire circumference of the rotor that is uniformly polarized in a single orientation. The stator is within the housing and laterally surrounds the rotatable shaft. The stator is configured to conduct the generated magnetic field to produce a voltage waveform signal. The controller is communicatively coupled to the stator. The controller is configured to receive the voltage waveform signal from the stator and determine an operating characteristic of the rotor based on the received voltage waveform signal.

18 Claims, 5 Drawing Sheets

(56) References Cited

U.S. PATENT DOCUMENTS

| | | | | |
|---|---|---|---|---|
| 2018/0180057 | A1 | 6/2018 | Krishnan et al. | |
| 2019/0085668 | A1* | 3/2019 | McMullen | E21B 4/04 |
| 2020/0032630 | A1 | 1/2020 | Artinian et al. | |
| 2020/0056462 | A1* | 2/2020 | Xiao | F04D 13/10 |
| 2020/0072030 | A1 | 3/2020 | Filatov et al. | |
| 2020/0208471 | A1 | 7/2020 | McMullen et al. | |
| 2020/0208509 | A1 | 7/2020 | Chen et al. | |

* cited by examiner

SENSING DURING ARTIFICIAL LIFT

TECHNICAL FIELD

This disclosure relates to artificial lift systems.

BACKGROUND

Artificial lift equipment, such as electric submersible pumps, compressors, and blowers, can be used in downhole applications to increase fluid flow within a well, thereby extending the life of the well. Such equipment, however, can fail due to a number of factors. Equipment failure can sometimes require workover procedures, which can be costly. On top of this, workover procedures can include shutting in a well in order to perform maintenance on equipment, resulting in lost production. Lost production negatively affects revenue and is therefore typically avoided when possible.

SUMMARY

Certain aspects of the subject matter described can be implemented as a system for operating in a wellbore in a subterranean formation. The system includes a housing. The system includes a rotor within the housing. The rotor includes a rotatable shaft. The rotor includes a fluid impeller coupled to the rotatable shaft. The fluid impeller is configured to induce fluid flow within the wellbore during rotation of the rotatable shaft. The rotor includes a magnetic field source in the housing. The magnetic field source is coupled to the rotatable shaft. The magnetic field source is configured to generate a net magnetic field around an entire circumference of the rotor that is uniformly polarized in a single orientation. The system includes a stator within the housing. The stator laterally surrounds the rotatable shaft of the rotor. The stator is configured to conduct the generated magnetic field to produce a voltage waveform signal. The system includes a controller that is communicatively coupled to the stator. The controller is configured to receive the voltage waveform signal from the stator. The controller is configured to determine an operating characteristic of the rotor based on the received voltage waveform signal.

This, and other aspects, can include one or more of the following features.

In some implementations, the net magnetic field generated by the magnetic field source is radially polarized.

In some implementations, the net magnetic field generated by the magnetic field source is axially polarized.

In some implementations, the housing defines a suction opening and a discharge opening, and the fluid impeller, magnetic field source, and stator are longitudinally positioned intermediate to the suction opening and the discharge opening.

In some implementations, the magnetic field source includes a permanent magnet that is disposed on a blade of the fluid impeller. In some implementations, the permanent magnet is sealed from contact with fluid surrounding the rotor.

In some implementations, the rotor includes multiple fluid impellers coupled to the rotatable shaft, and the magnetic field source includes multiple permanent magnets. In some implementations, each permanent magnet is sealed from contact with fluid surrounding the rotor and is associated with a different one of the fluid impellers. In some implementations, at least one of the permanent magnets is configured to generate a radial magnetic field. In some implementations, at least one other of the permanent magnets is configured to generate a circumferential magnetic field. Together, the multiple permanent magnets can be configured to generate the net magnetic field around the entire circumference of the rotor during rotation of the rotatable shaft.

In some implementations, determining the operating characteristic of the rotor includes identifying a pattern of voltages and frequencies of the received voltage waveform signal and determining the operating characteristic of the rotor based on the identified pattern.

In some implementations, the operating characteristic includes at least one of an operating temperature of the magnetic field source, an imbalance in the rotor, a rotation velocity of the rotor, a radial displacement of the rotatable shaft, or a presence of cavitation in the induced fluid flow.

In some implementations, the controller is configured to transmit data to a surface location. The data can correspond to the received voltage waveform signal or the determined operating characteristic.

In some implementations, the controller is configured to operate while disposed within the wellbore. In some implementations, determining the operating characteristic is performed downhole. In some implementations, the controller is configured to couple to an acoustic transmitter and to transmit acoustic data to a surface location via the acoustic transmitter. The acoustic data can correspond to the determined operating characteristic.

Certain aspects of the subject matter described can be implemented as a method. Fluid flow is induced within a wellbore in a subterranean formation by a fluid impeller coupled to a rotatable shaft of a rotor by rotating the rotatable shaft. During rotation of the rotatable shaft, a net magnetic field is generated around an entire circumference of the rotor. The net magnetic field is uniformly polarized in a single orientation. The generated magnetic field is conducted by a stator surrounding the rotatable shaft to produce a voltage waveform signal. The voltage waveform signal from the stator is received by a controller that is communicatively coupled to the stator. An operating characteristic of the rotor is determined by the controller based on the received voltage waveform signal.

This, and other aspects, can include one or more of the following features.

In some implementations, the net magnetic field is generated by a permanent magnet that is disposed on a blade of the fluid impeller. In some implementations, the permanent magnet is sealed from contact with fluid surrounding the rotor.

In some implementations, the net magnetic field is generated by multiple permanent magnets. In some implementations, each permanent magnet is sealed from contact with fluid surrounding the rotor and is associated with a different fluid impeller that is coupled to the rotatable shaft. In some implementations, the multiple permanent magnets together generate the net magnetic field around the entire circumference of the rotor. The net magnetic field generated by the multiple permanent magnets can be uniformly polarized in the single orientation.

In some implementations, determining the operating characteristic of the rotor includes determining a pattern of voltages and frequencies of the received voltage waveform signal and determining the operating characteristic of the rotor based on the determined pattern.

In some implementations, the operating characteristic includes at least one of an operating temperature of the permanent magnet, an imbalance in the rotor, a rotation velocity of the rotor, a radial displacement of the rotatable shaft, or a presence of cavitation in the induced fluid flow.

In some implementations, data is transmitted to a surface location by the controller. The data can correspond to the received voltage waveform signal or the determined operating characteristic.

In some implementations, determining the operating characteristic of the received voltage waveform signal is performed downhole. In some implementations, acoustic data is transmitted to a surface location by the controller via an acoustic transmitter coupled to the controller. The acoustic data can correspond to the determined operating characteristic.

Certain aspects of the subject matter described can be implemented as a system for operating in a wellbore in a subterranean formation. The system includes an electric submersible pump (ESP) and a controller. The ESP includes a rotatable shaft. The ESP includes a fluid impeller coupled to the rotatable shaft. The fluid impeller is configured to induce flow within the wellbore during rotation of the rotatable shaft. The ESP includes a magnetic field source coupled to the rotatable shaft. The magnetic field source is configured to generate a net magnetic field around an entire circumference of the fluid impeller. The net magnetic field is uniformly polarized in a single orientation. The ESP includes a pump housing that surrounds the fluid impeller and the rotatable shaft. The ESP includes a stator coil disposed in the pump housing. The stator coil laterally surrounds the rotatable shaft. The stator coil is configured to conduct the generated magnetic field to produce a voltage waveform signal. The controller is communicatively coupled to the stator coil of the ESP. The controller is remotely located from the ESP. The controller is configured to receive the voltage waveform signal from the stator coil. The controller is configured to determine an operating characteristic of the ESP based on the received voltage waveform signal.

This, and other aspects, can include one or more of the following features.

In some implementations, the controller is configured to operate while disposed within the wellbore uphole relative to the ESP. In some implementations, the controller is configured to couple to an acoustic transmitter. In some implementations, the controller is configured to transmit acoustic data to a surface location via the acoustic transmitter. The acoustic data can correspond to the determined operating characteristic.

In some implementations, the magnetic field source includes a permanent magnet disposed on a blade of the fluid impeller. In some implementations, the permanent magnet is sealed from contact with fluid within an inner bore of the pump housing.

In some implementations, determining the operating characteristic of the ESP includes identifying a pattern of voltages and frequencies of the received voltage waveform signal and determining the operating characteristic of the rotor based on the identified pattern.

In some implementations, the operating characteristic includes at least one of an operating temperature of the magnetic field source, an imbalance in the ESP, a rotation velocity of the ESP, a radial displacement of the rotatable shaft, or a presence of cavitation in the induced fluid flow.

In some implementations, the system includes a motor and a second controller. In some implementations, the motor is coupled to the rotatable shaft of the ESP. In some implementations, the motor is configured to rotate the rotatable shaft in response to receiving power. In some implementations, the motor includes a rotor and a sensor stator. In some implementations, the rotor of the motor includes a second sensor magnetic field source that is configured to generate a second net magnetic field around an entire circumference of the rotor of the motor. The second net magnetic field can be uniformly polarized in a single orientation. In some implementations, the sensor stator of the motor laterally surrounds the rotor. In some implementations, the sensor stator of the motor is configured to conduct the second magnetic field to produce a second voltage waveform signal. In some implementations, the second controller is communicatively coupled to the sensor stator of the motor. In some implementations, the second controller is configured to receive the second voltage waveform signal from the sensor stator of the motor. In some implementations, the second controller is configured to determine an operating characteristic of the motor based on the received second voltage waveform signal.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes artificial lift systems. Artificial lift systems installed downhole are often exposed to hostile downhole environments. Typical downhole pumps are not instrumented due to instrumentation reliability being subjected to such hostile downhole environments and the need for a power supply to drive the devices to perform the measurement. Current downhole sensors use existing sensor technologies packaged for downhole, resulting in compromises in performance. Achieving long operating life and integration in anything other than a specific, dedicated package for sensors can prove to be difficult. These limitations can hinder the operator's ability to know what is going on with the system during operation, for example, identifying increased vibration as an indication of impending bearing failure or possible buildup of scale on the pump impellers that is causing high unbalance loads on the bearings.

The subject matter described in this disclosure can be implemented in particular implementations, so as to realize one or more of the following features. The artificial lift systems described herein are integrated with passive sensor technology that can generate a signal based on rotor motion. Operational characteristics such as radial velocity and operating temperature can be determined at various locations, for example, within an electric submersible pump, motor, or protector. Pump parameters can be adjusted based on such determined characteristics to operate the system safely and mitigate risk of damage even during transient events, such as gas slugs, sand slugs, or sudden changes in pressure. The artificial lift systems described herein can be more reliable than comparable artificial lift systems, resulting in lower total capital costs over the life of a well. The improved reliability can also reduce the frequency of major repair, thereby reducing periods of lost production and maintenance costs. Changes over time of the vibration characteristics of an artificial lift system can provide prognostic data to allow for prediction of impending failure events, such as bearing failures or impeller blade failures. Bearing failures can be preceded by higher vibration levels and rotor displacement. Impeller blades can become clogged or damaged and be detected by gradual or step changes in vibration or rotor displacement.

Figure 1:
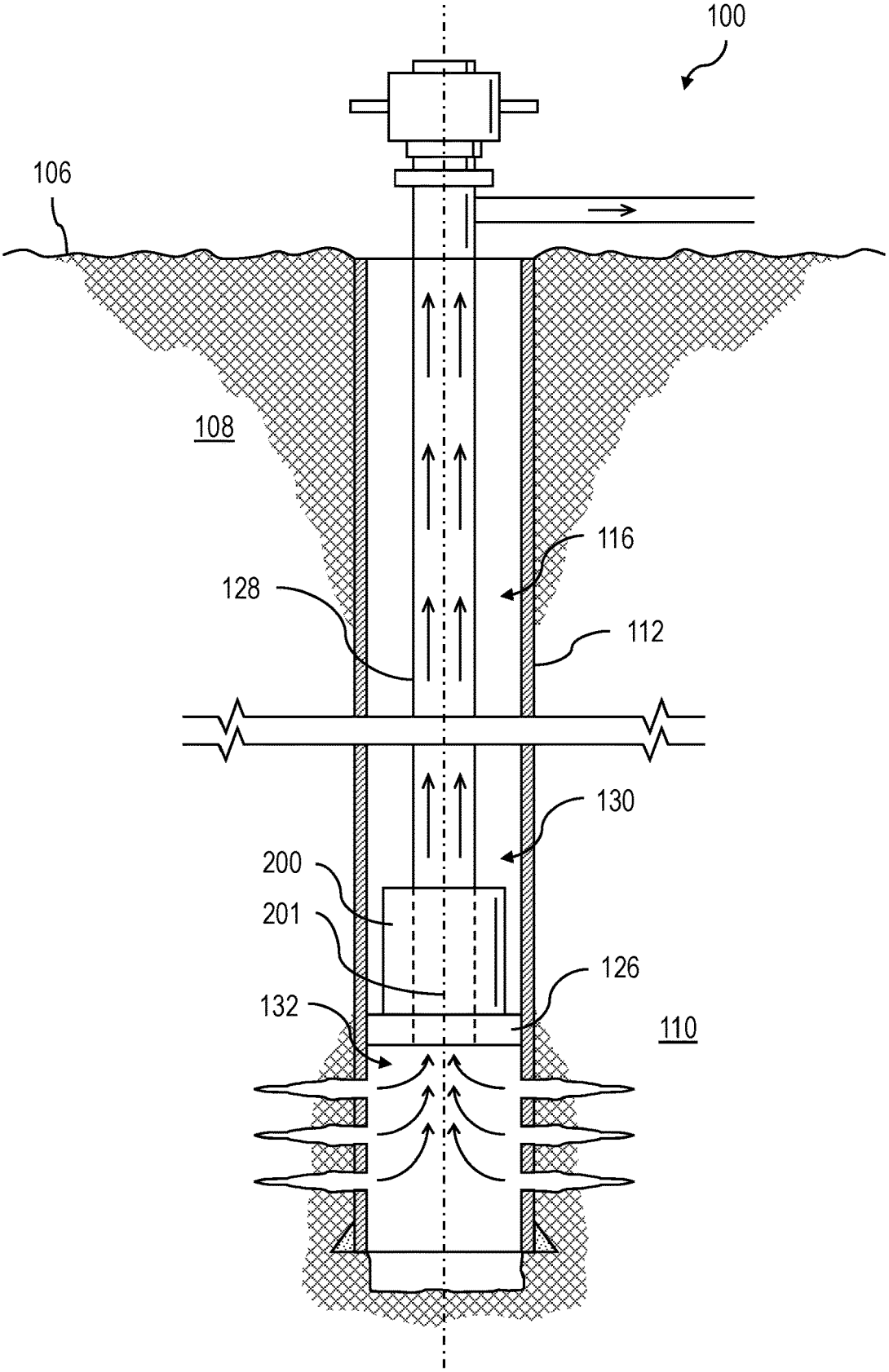
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to one or more subterranean zones of interest 110 to allow recovery (that is, production) of fluids to the surface 106 (represented by flow arrows in FIG. 1) and, in some implementations, additionally or alternatively allows fluids to be flowed into the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations. In certain instances, the formation can be a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured in any significant amount. For simplicity's sake, the well 100 is shown as a vertical well, but in other instances, the well 100 can be a deviated well with a wellbore deviated from vertical (for example, horizontal or slanted) and/or the well 100 can include multiple bores, forming a multilateral well (that is, a well having multiple lateral wells branching off another well or wells).

In some implementations, the well 100 is a gas well that is used in producing natural gas from the subterranean zones of interest 110 to the surface 106. While termed a "gas well," the well need not produce only dry gas, and may incidentally or in much smaller quantities, produce liquid including oil and/or water. In some implementations, the well 100 is an oil well that is used in producing crude oil from the subterranean zones of interest 110 to the surface 106. While termed an "oil well," the well not need produce only crude oil, and may incidentally or in much smaller quantities, produce gas and/or water. In some implementations, the production from the well 100 can be multiphase in any ratio, and/or can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly and/or otherwise) end-to-end of the same size or of different sizes. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached the wellhead. The Christmas tree includes valves used to regulate flow into or out of the well 100. The well 100 also includes an artificial lift system 200 residing in the wellbore, for example, at a depth that is nearer to subterranean zone 110 than the surface 106. The system 200, being of a type configured in size and robust construction for installation within a well 100, can include any type of rotating equipment that can assist production of fluids to the surface 106 and out of the well 100 by creating an additional pressure differential within the well 100. For example, the system 200 can include a pump, compressor, blower, or multi-phase fluid flow aid.

In particular, casing 112 is commercially produced in a number of common sizes specified by the American Petroleum Institute (the "API), including 4½, 5, 5½, 6, 6⅝, 7, 7⅝, 16/8, 9⅝, 10¾, 11¾, 13⅜, 16, 116/8 and 20 inches, and the API specifies internal diameters for each casing size. The system 200 can be configured to fit in, and (as discussed in more detail below) in certain instances, seal to the inner diameter of one of the specified API casing sizes. Of course, the system 200 can be made to fit in and, in certain instances, seal to other sizes of casing or tubing or otherwise seal to a wall of the well 100.

Additionally, the construction of the components of the system 200 are configured to operate while disposed within the well 100. That is, the components of the system 200 are configured to withstand the impacts, scraping, and other physical challenges the system 200 will encounter while being passed hundreds of feet/meters or even multiple miles/kilometers into and out of the well 100. For example, the system 200 can be disposed in the well 100 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the system 200 (including its components) is configured to withstand and operate for extended periods of time (e.g., multiple weeks, months or years) at the pressures and temperatures experienced in the well 200, which temperatures can exceed 400° F./205° C. and pressures over 2,000 pounds per square inch, and while submerged in the well fluids (gas, water, or oil as examples). Finally, the system 200 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), slickline (that is, a single stranded wire), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector). Some components of the system 200 (such as non-rotating parts and electrical systems, assemblies, and components) can be parts of or attached to the production tubing 128 to form a portion of the permanent completion, while other components (such as rotating parts) can be deployed within the production tubing 128.

A seal system 126 integrated or provided separately with a downhole system, as shown with the system 200, divides the well 100 into an uphole zone 130 above the seal system 126 and a downhole zone 132 below the seal system 126. FIG. 1 shows the system 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112, and includes the open hole wellbore wall in uncased portions of the well 100. Thus, the seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas- and liquid-tight seal at the pressure differential the system 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. For example, in certain instances, the seal system 126 includes a production packer. Although not shown in FIG. 1, additional components, such as a surface compressor, can be used in conjunction with the system 200 to boost pressure in the well 100.

In some implementations, the system 200 can be implemented to alter characteristics of a wellbore by a mechanical intervention at the source. Alternatively, or in addition to any of the other implementations described in this specification, the system 200 can be implemented as a high flow, low pressure rotary device for gas flow in sub-atmospheric wells. Alternatively, or in addition to any of the other implementations described in this specification, the system 200 can be implemented in a direct well-casing deployment for production through the wellbore. Other implementations of the system 200 as a pump, compressor, or multiphase combination of these can be utilized in the well bore to effect increased well production.

The system 200 locally alters the pressure, temperature, and/or flow rate conditions of the fluid in the well 100 proximate the system 200. In certain instances, the alteration performed by the system 200 can optimize or help in optimizing fluid flow through the well 100. As described previously, the system 200 creates a pressure differential within the well 100, for example, particularly within the locale in which the system 200 resides. In some instances, a pressure at the base of the well 100 is a low pressure (for example, sub-atmospheric); so unassisted fluid flow in the wellbore can be slow or stagnant. In these and other instances, the system 200 introduced to the well 100 adjacent the perforations can reduce the pressure in the well 100 near the perforations to induce greater fluid flow from the subterranean zone 110, increase a temperature of the fluid entering the system 200 to reduce condensation from limiting production, and/or increase a pressure in the well 100 uphole of the system 200 to increase fluid flow to the surface 106.

The system 200 moves the fluid at a first pressure downhole of the system 200 to a second, higher pressure uphole of the system 200. The system 200 can operate at and maintain a pressure ratio across the system 200 between the second, higher uphole pressure and the first, downhole pressure in the wellbore. The pressure ratio of the second pressure to the first pressure can also vary, for example, based on an operating speed of the system 200.

The system 200 can operate in a variety of downhole conditions of the well 100. For example, the initial pressure within the well 100 can vary based on the type of well, depth of the well 100, production flow from the perforations into the well 100, and/or other factors. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The system 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The system 200 can operate in above atmospheric well pressures, for example, at well pressure between 14.7 psia (101.3 kPa) and 5,000 psia (34,474 kPa).

Figure 2A:
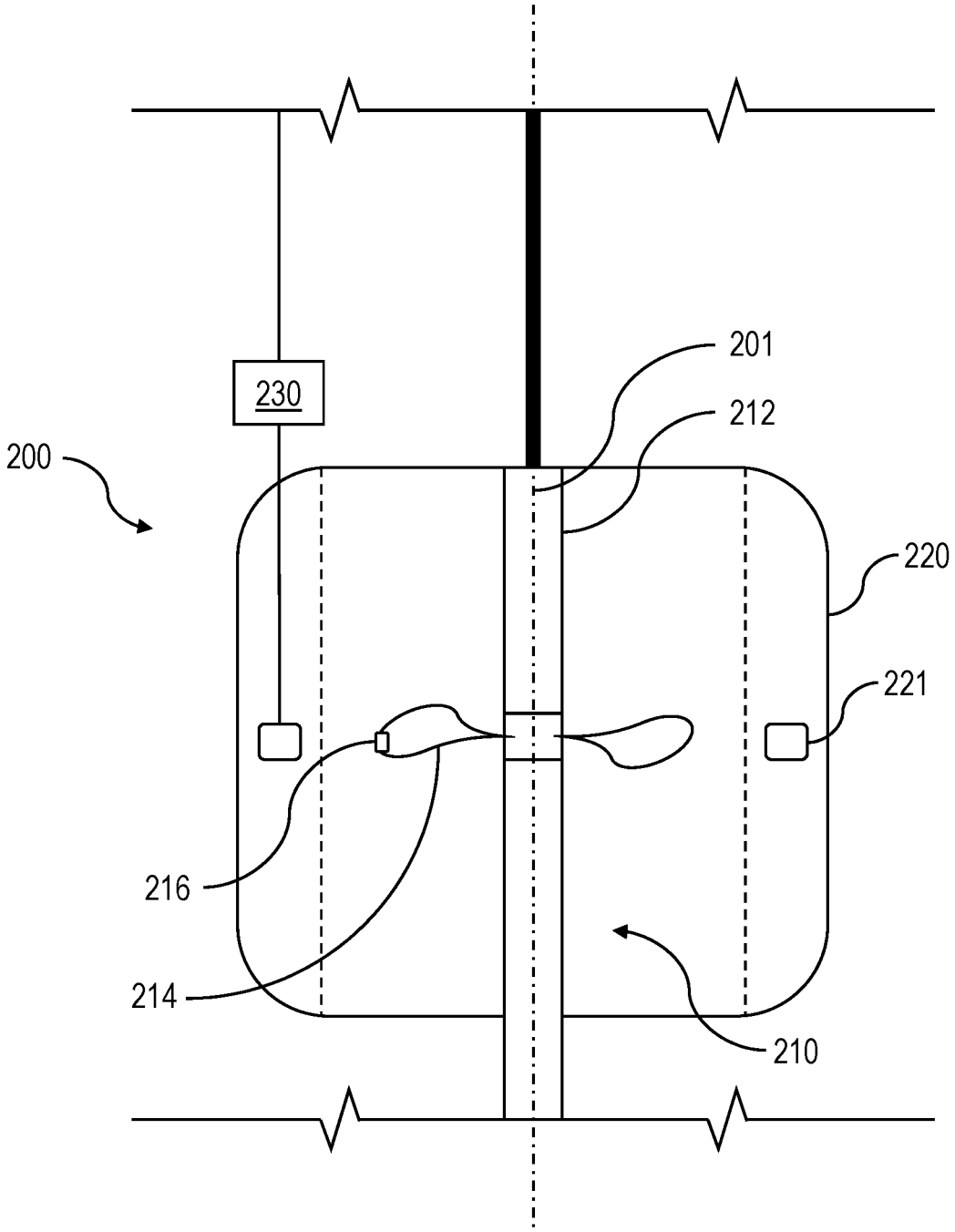
FIG. 2A is a schematic diagram of an example system disposed within the well of FIG. 1.

Referring to FIG. 2A, as discussed previously, the system 200 is for operating in a wellbore in a subterranean formation. For example, the system 200 can be disposed and operated in the well 100. The system 200 includes a rotor 210, a housing 220, a sensor stator 221, and a controller 230. The rotor 210 includes a rotatable shaft 212, a fluid impeller 214, and a magnetic field source 216. The fluid impeller 214 is coupled to the rotatable shaft 212. The magnetic field source 216 is disposed within the housing 220 and coupled to the rotatable shaft 212. The housing 220 surrounds the fluid impeller 214 and at least a portion of the rotatable shaft 212. The sensor stator 221 is disposed within the housing 220. The sensor stator 221 laterally surrounds the rotatable shaft 212 of the rotor 210. The controller 230 is communicatively coupled to the sensor stator 221. Centerline 201 is the central longitudinal axis of the system 200. Under normal operation of system 200, the rotatable shaft 212 rotates in line with the centerline 201.

The rotatable shaft 212 can be, for example, coupled to a motor. In some implementations, the rotatable shaft 212 extends from the motor and through an inner bore of the housing 220. The fluid impeller 214 is configured to induce fluid flow within the wellbore (for example, within the well 100) during rotation of the rotatable shaft 212. Although shown in FIG. 2A as including a single fluid impeller 214, the system 200 can include additional fluid impellers 214. Similarly, the system 200 can include other duplicate components, such as additional magnetic field sources 216. Further, the system 200 can include auxiliary components not shown in FIG. 2A, such as bearings.

The magnetic field source 216 is configured to generate a net magnetic field around an entire circumference of the rotor 210. The net magnetic field generated by the magnetic field source 216 is uniformly polarized in a single orientation. In some implementations, the net magnetic field generated by the magnetic field source 216 is radially polarized in a single orientation. In some implementations, the net magnetic field generated by the magnetic field source 216 is axially polarized in a single orientation. In some implementations, the magnetic field source 216 is a permanent magnet that is disposed on a blade of the fluid impeller 214, which is coupled to the rotatable shaft 212. In some implementations, the magnetic field source 216 is disposed on another portion of the rotor 210. In some implementations, the magnetic field source 216 is a ring of permanent magnets that is disposed on the rotatable shaft 212 and shares a common central axis with the rotatable shaft 212 (for example, aligned with the centerline 201).

In some implementations with multiple fluid impellers 214, the fluid impellers 214 that do not have a magnetic field source 216 disposed on their respective blades can include a weight that counterbalances the weight of the magnetic field source 216 for even weight distribution during rotation of the rotatable shaft 212. In implementations of the system 200 that include multiple magnetic field sources 216 (for example, multiple permanent magnets), the multiple magnetic field sources 216 can work together to generate the net magnetic field around the entire circumference of the rotor 210. For example, each permanent magnet can have its own magnetic field, and all of the permanent magnets rotating together with the rotatable shaft 212 can generate an overall (net) magnetic field around the entire circumference of the rotor 210 that is radially polarized in a single orientation (for example, radially outward) or axially polarized in a single orientation. The multiple magnetic field sources 216 can be evenly distributed around a circumference of the rotor 210 for even weight distribution during rotation of the rotatable shaft 212.

The magnetic field source 216 is sealed from the fluid surrounding the rotor 210. In some implementations, the magnetic field source 216 is sealed with a corrosion-resistant metal that is compatible with the downhole conditions and downhole fluids. For example, the magnetic field source 216 is sealed from exposure to downhole fluids by a sleeve made of a non-magnetic material (e.g., Inconel, titanium, stainless steel, carbon fiber composite, and/or another non-magnetic material). The thickness of the material sealing the magnetic field source 216 is sufficient to support pressure differentials experienced downhole at the depths at which the system 200 is disposed within the well 100.

The fluid impeller 214 and at least a portion of the rotatable shaft 212 resides within the inner bore of the housing 220. The sensor stator 221 is configured to conduct the magnetic field generated by the magnetic field source 216 to produce a voltage waveform signal. In some implementations, the sensor stator 221 includes a coil wrapped around a core. The coil can generate a voltage as a result of a changing magnetic field passing through the core. In some implementations, the sensor stator 221 includes a coil wrapped around a horseshoe laminated core stack. In some implementations, the sensor stator 221 includes coils wrapped around poles of a circular core stack. In some implementations, the sensor stator 221 includes multiple coils, for example, two coils positioned at opposite sides of a circumference of the housing 220 or multiple coils distributed equally or unequally around a circumference of the rotor 210.

The sensor stator 221 is sealed from the fluid surrounding the rotor 210. In some implementations, the sensor stator 221 is sealed with a corrosion-resistant metal that is compatible with the downhole conditions and downhole fluids. For example, the sensor stator 221 is sealed from exposure to downhole fluids by a housing made of a non-magnetic material (e.g., Inconel, titanium, stainless steel, carbon fiber composite, and/or another non-magnetic material). The thickness of the material sealing the sensor stator 221 is sufficient to support pressure differentials experienced downhole at the depths at which the system 200 is disposed within the well 100. In some implementations, the thickness of the material sealing the sensor stator 221 is similar to or the same as the thickness of the production tubing 128.

The controller 230 is configured to receive the voltage waveform signal from the sensor stator 221. The controller 230 is configured to determine an operating characteristic of the rotor 210 based on the voltage waveform signal received from the sensor stator 221. Some examples of operating characteristics that can be determined by the controller 230 include an operating temperature of the magnetic field source 216, an imbalance in the rotor 210, a rotation velocity of the rotor 210, a radial displacement of the rotatable shaft 212 of the rotor 210, a presence of cavitation in the induced fluid flow surrounding the rotor 210, and a presence of a slug (for example, a gas slug or a sand slug) in the induced fluid flow surrounding the rotor 210.

Being a component of the system 200, the controller 230 is configured to operate while disposed within the well 100. For example, the controller 230 can be disposed within a sealed housing and electronics connected to the controller 230 can be ruggedized to withstand or be insulated from downhole temperatures, downhole pressures, and downhole fluids (which may be corrosive, erosive, or both). In some implementations, the controller 230 is configured to transmit data to a surface location external to the wellbore. The data can, for example, correspond to the voltage waveform signal received from the sensor stator 221 (an example of raw data) or the operating characteristic determined by the processor 230 (an example of processed data). In implementations in which the controller 230 transmits raw data to the surface location, a portion of the controller 230 can be disposed within the wellbore while another portion of the controller 230 resides at the surface. For example, the downhole portion of the controller 230 can transmit raw data to the surface-residing portion of the controller 230, and the surface-residing portion of the controller 230 can process the raw data and/or transmit the raw data to a third party system for processing. In some implementations, the controller 230 is configured to reside at a surface location. For example, the voltage waveform signal from the sensor stator 221 can be transmitted to the surface-residing controller 230, which can process the voltage waveform signal and/or transmit the voltage waveform signal to a third party system for processing.

Determining the operating characteristic can include identifying a pattern of voltages (magnitudes) and frequencies of the voltage waveform signal received from the sensor stator 221 and determining an operating characteristic of the rotor 210 based on the identified pattern. For example, a first identified pattern of voltages and/or frequencies can correspond to an imbalance in the rotor 210 at synchronous frequency, a second identified pattern of voltages and/or frequencies can correspond to motion at a rigid body mode of the rotor 210 because of being lightly damped, and a third identified pattern of voltages and/or frequencies can correspond to a fluid impeller 214 frequency that is at several times (for example, 8× or 10×) the synchronous frequency. As another example, a fourth identified pattern of voltages and/or frequencies can exhibit low frequency vibration characteristics which can correspond to the presence of gas in the fluid surrounding the rotor 210 (for example, due to a gas slug or cavitation).

In some implementations, the controller 230 is configured to process the voltage waveform signal received from the sensor stator 221 and calibrate a relationship between the voltage vs. frequency of the received voltage waveform signal and an operating characteristic of the rotor 210. In order to calculate radial velocity of the rotor 210, the controller 230 can calibrate the relationship between magnitude vs. frequency of the voltage waveform signal and radial velocity to take account of fixed displacement, in which greater voltages are produced at higher frequencies. As another example, the controller 230 can calibrate the relationship between magnitude of the voltage waveform signal and temperature to determine an operating temperature of the rotor 210. As another example, the controller 230 can calibrate the relationship between magnitude vs. frequency of the voltage waveform signal and an operating characteristic of the rotor 210 to take account of skin effect attenuation, which reduces the voltage as frequency increases. Such effects can be modeled to properly scale output signals and accurately measure vibrations at various ranges of frequencies within the system 200. Such calibration and processing can be implemented by the controller 230 while the controller 230 is disposed within the well 100.

In some implementations, the controller 230 is configured to process the voltage waveform signal received from the sensor stator 221 and transmit a reduced form of data to a surface location, where the data can be further processed. For example, a portion of the controller 230 that is disposed downhole within the well 100 processes the voltage waveform signal received from the sensor stator 221 and transmits the reduced form of data to another portion of the controller 230 that is located at the surface. In some implementations, the controller 230 is configured to controller 230 is configured to transmit raw data corresponding to the voltage waveform signal received from the sensor stator 221 to a surface location, where the data can be processed. For example, a portion of the controller 230 that is disposed downhole within the well 100 transmits raw data corresponding to the voltage waveform signal received from the sensor stator 221 to another portion of the controller 230 that is located at the surface. The surface-located portion of the controller 230 can then process the data or transmit the data to a third party system for processing.

In some implementations, the controller 230 is configured to improve a signal-to-noise ratio of the voltage waveform signal received from the sensor stator 221. For example, the controller 230 can average the voltage waveform signal or ignore certain bandwidths of frequencies, especially in cases where there is an expected range. For example, when a known temperature average is used as a baseline value (such as at 20° C.), an operating temperature of the magnetic field source 216 can be estimated by also taking into consideration the material of construction of the magnetic field source 216. For example, if the magnetic field source 216 includes a samarium-cobalt based permanent magnet, a 0.03% decrease in flux density can be expected per 1° C. increase in operating temperature. For example, if the magnetic field source 216 includes a neodymium iron boron-based permanent magnet, a 0.11% decrease in flux density can be expected per 1° C. increase in operating temperature. As such, the system 200 also exhibits temperature sensing capability.

The controller 230 can determine multiple operating characteristics over a time period (for example, over a month, several months, or years) to assess and monitor operation of the system 200. For example, the operating characteristics determined by the controller 230 (such as imbalanced motion of the rotor 210) can indicate wear of the fluid impeller 214 (for example, by erosion), material build up on the fluid impeller 214 (for example, in the form of deposits), or both. For example, the operating characteristics determined by the controller 230 can be tracked and compared over a time period to identify operating condition changes, such as gas in fluid flow (which can cause cavitation), particulates in fluid flow (such as sand), changes in rate of fluid flow through the system 200, changes in fluid properties, changes in well pressure, or a combination of these. For example, the operating characteristics determined by the controller 230 can be used to identify changes in ESP operation, such as bearing wear, failure, or contamination and ESP inlet clogging. Identifying such conditions can allow for proactive and preventative maintenance, which can extend the overall operating life of the system 200. The sensing capabilities of the system 200 allow for real-time identification of potential issues upon which an operator can act on proactively to mitigate such situations before they become catastrophic. The operation and maintenance of the system 200 can therefore shift toward being more proactive rather than reactive.

In some implementations, the controller 230 is configured to couple to an acoustic transmitter. In such implementations, the controller 230 can be configured to transmit acoustic data to a surface location via the acoustic transmitter. The acoustic data can, for example, correspond to an operating characteristic determined by the controller 230 or raw data, such as the voltage waveform signal received from the sensor stator 221. An implementation of the controller 230 is shown also in FIG. 3 and is described in more detail later.

In some implementations, sensor stator 221 is disposed around an outer circumference of the production tubing 128. In some implementations, the sensor stator 221 is permanently installed in the well 100 as part of a completion string. In such implementations, the controller 230 can be disposed in an annulus between the production tubing 128 and the casing 112, and the controller 230 can be communicatively coupled to the sensor stator 221 and to a surface location by wires that run through the annulus between the production tubing 128 and the casing 112.

Figure 2B:
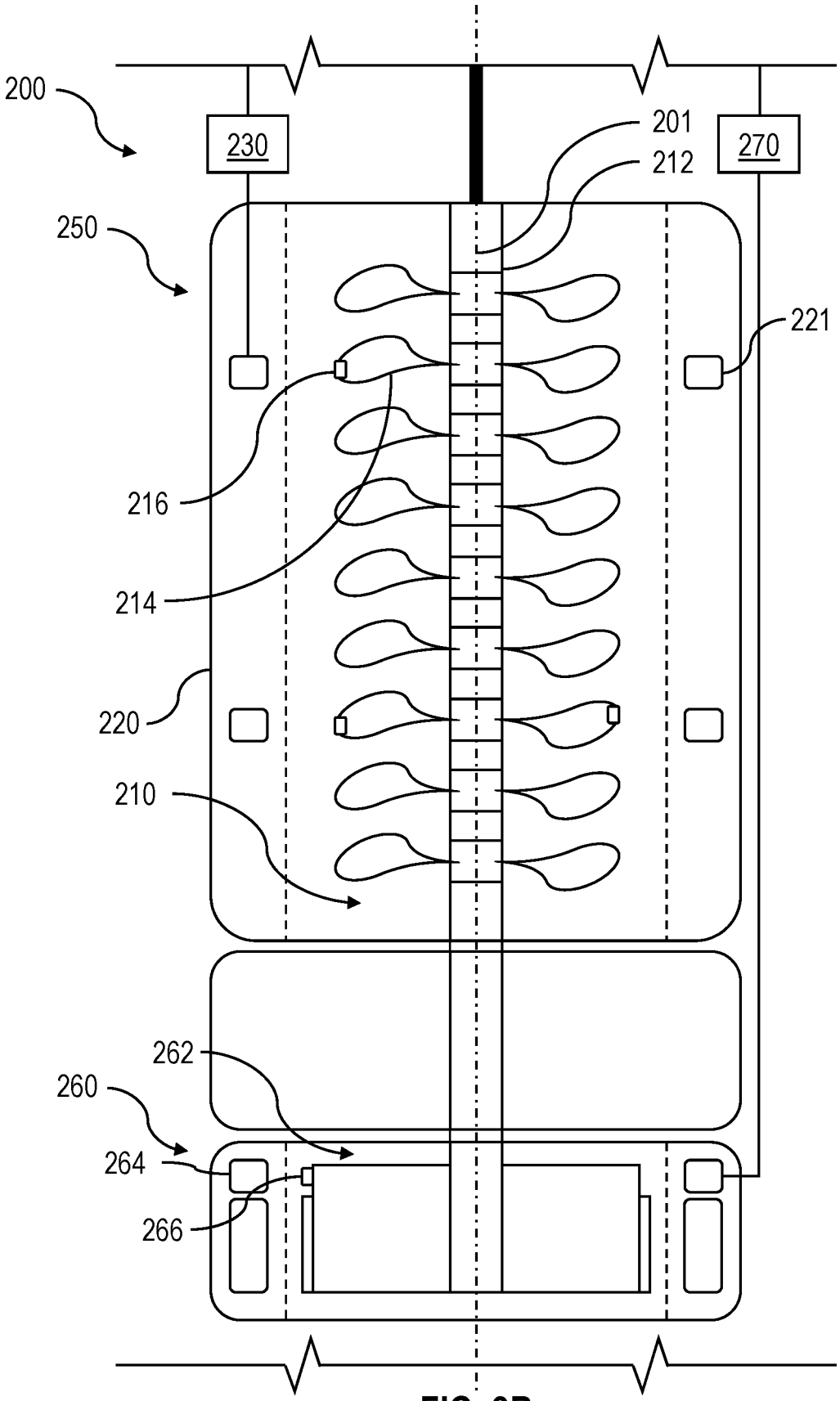
FIG. 2B is a schematic diagram of an example system disposed within the well of FIG. 1.

FIG. 2B shows an implementation of the system 200 that is substantially similar to the system 200 shown in FIG. 2A. In some implementations, the rotatable shaft 212 and fluid impeller 214 form a rotor 210 of an electric submersible pump (ESP) 250, and the sensor stator 221 is disposed within a pump housing 220 of the ESP 250. In such implementations, the coil that conducts the magnetic field generated by the magnetic field source 216 can be disposed within the pump housing of the ESP 250. In some implementations, the controller 230 of the system 200 can be disposed within the well 100 uphole relative to the ESP 250. For example, the controller 230 can be located within a zone of the well 100 that has a cooler operating temperature in comparison to the locale at which the ESP 250 resides within the well 100.

In some implementations, the system 200 includes a motor 260 coupled to the rotatable shaft 212 of the ESP 250. The motor 260 is configured to rotate the rotatable shaft 212 in response to receiving power. The motor 260 includes a motor rotor 262 and a motor stator. The motor rotor 262 includes a magnetic field source that interacts with the motor stator to generate rotational motion to rotate the rotatable shaft 212. In some implementations, in addition to this magnetic field source, the motor rotor 262 includes a sensor magnetic field source 266 that is configured to generate a magnetic field around an entire circumference of the motor rotor 262 (similar to the magnetic field source 216). The magnetic field generated by the sensor magnetic field source 266 is uniformly polarized in a single orientation. In such implementations, in addition to the motor stator, the motor 260 includes a sensor stator 264 surrounds the motor rotor 262. The sensor stator 264 is configured to conduct the magnetic field generated by the sensor magnetic field source 266 to produce a voltage waveform signal (similar to the sensor stator 221). In some implementations, the magnetic field generated by the sensor magnetic field source 266 is radially polarized. In some implementations, the magnetic field generated by the sensor magnetic field source 266 is axially polarized.

In some implementations, the system 200 includes a second controller 270 that is substantially the same as the controller 230. The second controller 270 is communicatively coupled to the motor stator 264. The second controller 270 is configured to receive the voltage waveform signal produced by the motor stator 264. The second controller 270 is configured to determine an operating characteristic of the motor 260 based on the voltage waveform signal received from the motor stator 264. In some implementations, the controller 230 is communicatively coupled to both the sensor stator 221 and the motor sensor stator 264. In such implementations, the controller 230 can transmit data and/or process data received from both the sensor stator 221 and the motor sensor stator 264. In such implementations, the controller 230 is configured to tag data that identifies the data as being associated with the sensor stator 221 or the motor sensor stator 264.

The configuration of generating a net magnetic field that is uniformly polarized in a single orientation by a magnetic field source (216 or 266), producing a voltage waveform signal by a coil (of sensor stator 221 or 264), and data processing of the voltage waveform signal by a controller (230 or 270) can be repeated for as many components along a string in the well 100 as desired. For example, another set of magnetic field source, sensor stator coil, and controller can be designated for a different fluid impeller that is longitudinally distanced from the fluid impeller 214 to monitor pump operation in the vicinity of that particular fluid impeller. This duplication can be especially useful in systems will many pump stages (for example, a pump system that is over 100 feet in longitudinal length with hundreds of fluid impellers), where various pump imbalances can be present over the entire longitudinal length of the pump system. A set of magnetic field source, sensor stator coil, and controller can optionally be designated for fluid impellers, spaces between neighboring fluid impellers, and/or groups of fluid impellers that are intermediate the ends of the housing 220 (for example, the pump suction or discharge).

Figure 3:
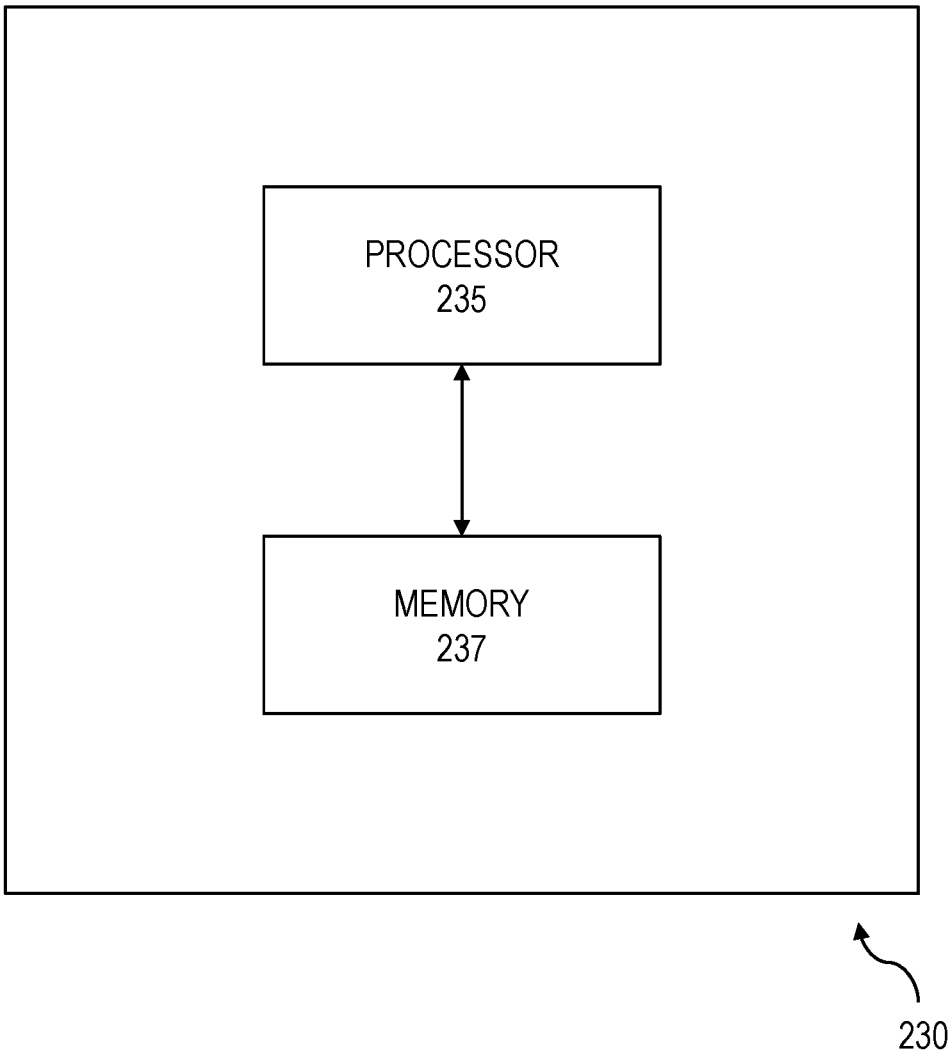
FIG. 3 is a schematic diagram of an example controller that can be implemented in the systems of FIGS. 2A and 2B.

FIG. 3 shows an implementation of the controller 230. The controller 230 is intended to encompass a computing device. In some implementations, the controller 230 includes an input device that can accept user information and an output device that conveys information associated with the operation of the controller 230, such as digital data, visual information, audio information, or a combination of information.

The controller 230 includes a processor 235. Although illustrated as a single processor 235 in FIG. 3, two or more processors may be used according to particular needs, desires, or particular implementations of the controller 230. Generally, the processor 235 executes instructions and manipulates data to perform the operations of the controller 230 and any algorithms, methods, functions, processes, flows, and procedures as described in this specification.

The controller 230 includes a memory 237 that can hold data for the controller 230 or other components (or a combination of both) that can be connected to the network. Although illustrated as a single memory 237 in FIG. 3, two or more memories 237 (of the same or combination of types) can be used according to particular needs, desires, or particular implementations of the controller 230 and the described functionality. The memory 237 can be a transitory or non-transitory storage medium. The memory 237 stores computer-readable instructions executable by the processor 235 that, when executed, cause the processor 235 to perform operations, such as receiving the voltage waveform signal from the sensor stator 221 and determining an operating characteristic of the rotor 210 based on the voltage waveform signal received from the sensor stator 221.

Figure 4:
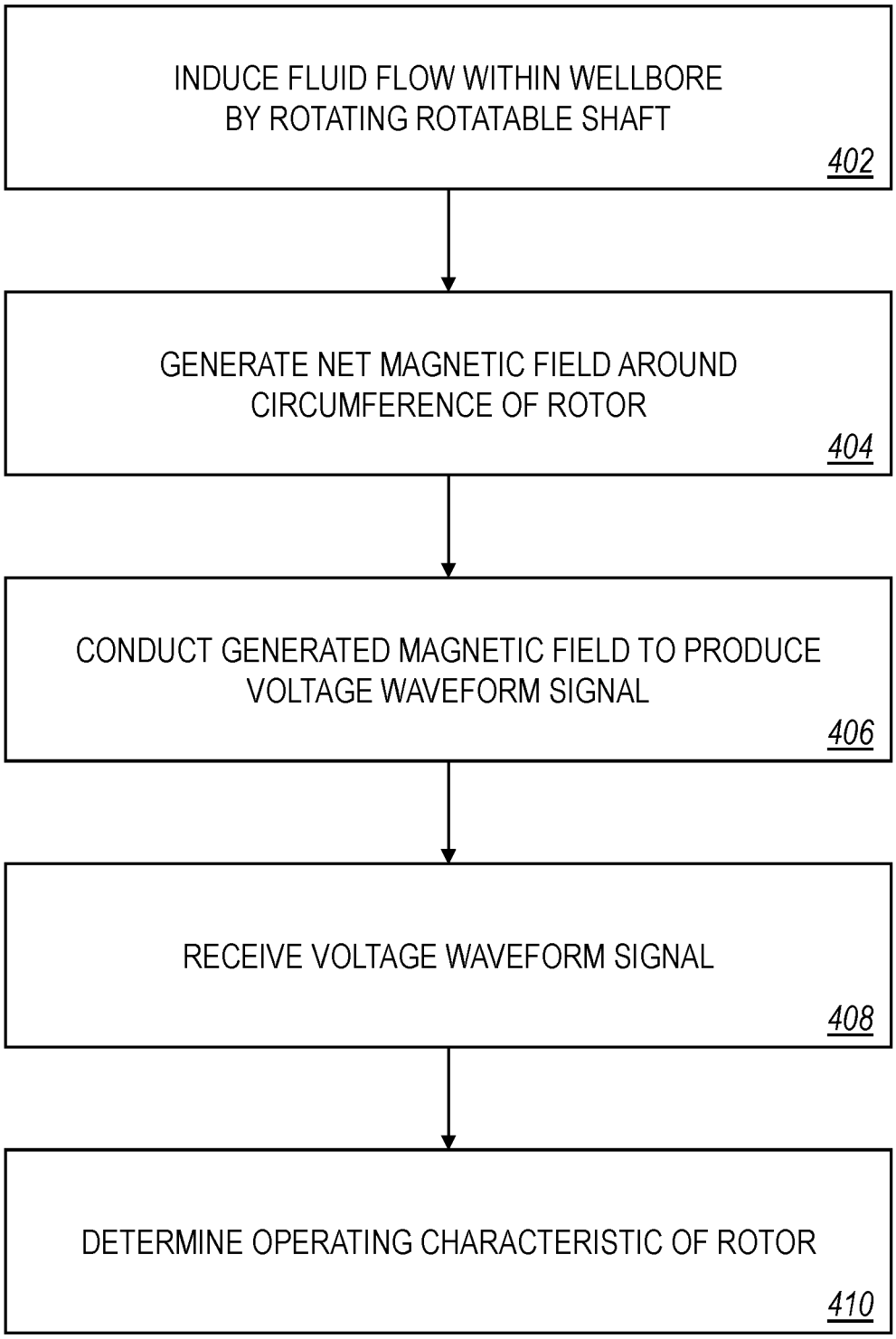
FIG. 4 is a flow chart of an example method that can be implemented by the systems of FIGS. 2A and 2B.

FIG. 4 is a flow chart of an example method 400, which can be implemented by the system 200 while the system 200 is disposed within the well 100. At step 402, fluid flow within a wellbore in a subterranean formation (for example, within the well 100) is induced by a fluid impeller (for example, the fluid impeller 214) coupled to a rotatable shaft (for example, the rotatable shaft 212) of a rotor (for example, the rotor 210) by rotating the rotatable shaft 212.

At step 404 during rotation of the rotatable shaft 212, a net magnetic field is generated around an entire circumference of the rotor 210. The magnetic field generated at step 404 is uniformly polarized in a single orientation. In some implementations, the magnetic field generated at step 404 is radially polarized in a single orientation. In some implementations, the magnetic field generated at step 404 is axially polarized in a single orientation. The magnetic field source 216 of system 200 can generate the magnetic field at step 404. For example, a permanent magnet (sealed from contact with fluid surrounding the rotor 210) that is disposed on a blade of the fluid impeller 214 (or another portion of the rotor 210) generates the magnetic field at step 404.

At step 406, the magnetic field generated at step 404 is conducted by a stator (for example, the sensor stator 221) positioned in one or more locations surrounding the rotatable shaft 212 to produce a voltage waveform signal. For example, the magnetic field generated at step 404 induces a voltage in a coil of the sensor stator 221 as a result of the rotor 210 displacing from the centerline 201. The fluctuations in the magnetic field generated at step 404 (for example, due to a rotor imbalance or deviation of the rotatable shaft 212 from a centerline) causes the coil of the sensor stator 221 to produce the voltage waveform signal at step 406.

At step 408, the voltage waveform signal from the sensor stator 221 is received by a controller (for example, the controller 230) that is communicatively coupled to the sensor stator 221. The voltage waveform signal includes a combination of voltages (magnitudes) and frequencies.

At step 410, an operating characteristic of the rotor 210 is determined by the controller 230 based on the voltage waveform signal received at step 408. Some examples of operating characteristics that can be determined by the controller 230 at step 410 include an operating temperature of the magnetic field source 216, an imbalance in the rotor 210, a rotation velocity of the rotor 210, a radial displacement of the rotatable shaft 212 of the rotor 210, a presence of cavitation in the induced fluid flow surrounding the rotor 210, and a presence of a slug (for example, a gas slug or a sand slug) in the induced fluid flow surrounding the rotor 210. Determining the operating characteristic can include identifying a pattern of voltages (magnitudes) and frequencies of the voltage waveform signal received from the sensor stator 221 and determining an operating characteristic of the rotor 210 based on the identified pattern.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part. Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A system for operating in a wellbore in a subterranean formation, the system comprising:

a housing;

a rotor within the housing, the rotor comprising:

a rotatable shaft;

a plurality of fluid impellers coupled to the rotatable shaft, the plurality of fluid impellers configured to, during rotation of the rotatable shaft, induce fluid flow within the wellbore; and a magnetic field source in the housing coupled to the rotatable shaft, the magnetic field source configured to generate a net magnetic field around an entire circumference of the rotor that is uniformly polarized in a single orientation, the magnetic field source comprising a plurality of permanent magnets, each permanent magnet sealed from contact with fluid surrounding the rotor and associated with a different one of the plurality of fluid impellers, at least one of the plurality of permanent magnets is configured to generate a radial magnetic field, at least one other of the plurality of permanent magnets is configured to generate a circumferential magnetic field, and the plurality of permanent magnets is configured to, during rotation of the rotatable shaft, generate the net magnetic field around the entire circumference of the rotor;

a stator within the housing, laterally surrounding the rotatable shaft of the rotor, the stator configured to conduct the generated magnetic field to produce a voltage waveform signal; and a controller communicatively coupled to the stator, the controller configured to:

receive the voltage waveform signal from the stator; and determine an operating characteristic of the rotor based on the received voltage waveform signal.

2. The system of claim 1, wherein the net magnetic field generated by the magnetic field source is radially polarized.

3. The system of claim 1, wherein the net magnetic field generated by the magnetic field source is axially polarized.

4. The system of claim 1, wherein the housing defines a suction opening and a discharge opening, and the fluid impeller, magnetic field source, and stator are longitudinally positioned intermediate to the suction opening and discharge opening.

5. The system of claim 1, wherein determining the operating characteristic of the rotor comprises identifying a pattern of voltages and frequencies of the received voltage waveform signal and determining the operating characteristic of the rotor based on the identified pattern.

6. The system of claim 5, wherein the operating characteristic comprises at least one of an operating temperature of the magnetic field source, an imbalance in the rotor, a rotation velocity of the rotor, a radial displacement of the rotatable shaft, or a presence of cavitation in the induced fluid flow.

7. The system of claim 6, wherein the controller is configured to transmit data to a surface location, the data corresponding to the received voltage waveform signal or the determined operating characteristic.

8. The system of claim 6, wherein:

the controller is configured to operate while disposed within the wellbore;

determining the operating characteristic is performed downhole; and the controller is configured to couple to an acoustic transmitter and to transmit acoustic data to a surface location via the acoustic transmitter, the acoustic data corresponding to the determined operating characteristic.

9. A method, comprising:

inducing, by a plurality of fluid impellers coupled to a rotatable shaft of a rotor, fluid flow within a wellbore in a subterranean formation by rotating the rotatable shaft;

during rotation of the rotatable shaft, generating a net magnetic field around an entire circumference of the rotor that is uniformly polarized in a single orientation, wherein the net magnetic field is generated by a plurality of permanent magnets, each permanent magnet sealed from contact with fluid surrounding the rotor and associated with a different one of the plurality of fluid impellers coupled to the rotatable shaft, and the plurality of permanent magnets together generate the net magnetic field around the entire circumference of the rotor that is uniformly polarized in the single orientation;

conducting, by a stator surrounding the rotatable shaft, the generated magnetic field to produce a voltage waveform signal;

receiving, by a controller communicatively coupled to the stator, the voltage waveform signal from the stator; and determining, by the controller, an operating characteristic of the rotor based on the received voltage waveform signal.

10. The method of claim 9, wherein determining the operating characteristic of the rotor comprises determining a pattern of voltages and frequencies of the received voltage waveform signal and determining the operating characteristic of the rotor based on the determined pattern.

11. The method of claim 10, wherein the operating characteristic comprises at least one of an operating temperature of the permanent magnet, an imbalance in the rotor, a rotation velocity of the rotor, a radial displacement of the rotatable shaft, or a presence of cavitation in the induced fluid flow.

12. The method of claim 10, comprising transmitting, by the controller, data to a surface location, the data corresponding to the received voltage waveform signal or the determined operating characteristic.

13. The method of claim 10, wherein determining the operating characteristic of the received voltage waveform signal is performed downhole, and the method comprises transmitting, by the controller, acoustic data to a surface location via an acoustic transmitter coupled to the controller, the acoustic data corresponding to the determined operating characteristic.

14. A system for operating in a wellbore in a subterranean formation, the system comprising:

an electric submersible pump (ESP) comprising:

a rotatable shaft;

a plurality of fluid impellers coupled to the rotatable shaft, the plurality of fluid impellers configured to, during rotation of the rotatable shaft, induce fluid flow within the wellbore;

a magnetic field source coupled to the rotatable shaft, the magnetic field source configured to generate a net magnetic field around an entire circumference of the plurality of fluid impellers that is uniformly polarized in a single orientation, the magnetic field source comprising a plurality of permanent magnets, each permanent magnet associated with a different one of the plurality of fluid impellers, and the plurality of permanent magnets is configured to, during rotation of the rotatable shaft, generate the net magnetic field around the entire circumference of the plurality of fluid impellers;

a pump housing surrounding the plurality of fluid impellers and the rotatable shaft, wherein each permanent magnet is sealed from contact with fluid within an inner bore of the pump housing; and a stator coil disposed in the pump housing and laterally surrounding the rotatable shaft, the stator coil configured to conduct the generated magnetic field to produce a voltage waveform signal; and a controller communicatively coupled to the stator coil of the ESP, the controller remotely located from the ESP, the controller configured to:

receive the voltage waveform signal from the stator coil; and determine an operating characteristic of the ESP based on the received voltage waveform signal.

15. The system of claim 14, wherein the controller is configured to:

operate while disposed within the wellbore uphole relative to the ESP;

couple to an acoustic transmitter; and transmit acoustic data to a surface location via the acoustic transmitter, the acoustic data corresponding to the determined operating characteristic.

16. The system of claim 15, wherein determining the operating characteristic of the ESP comprises identifying a pattern of voltages and frequencies of the received voltage waveform signal and determining the operating characteristic of the ESP based on the identified pattern.

17. The system of claim 16, wherein the operating characteristic comprises at least one of an operating temperature of the magnetic field source, an imbalance in the ESP, a rotation velocity of the ESP, a radial displacement of the rotatable shaft, or a presence of cavitation in the induced fluid flow.

18. The system of claim 17, comprising:

a motor coupled to the rotatable shaft of the ESP, the motor configured to rotate the rotatable shaft in response to receiving power, the motor comprising:

a rotor comprising a second sensor magnetic field source configured to generate a second net magnetic field around an entire circumference of the rotor that is uniformly polarized in a single orientation; and a sensor stator laterally surrounding the rotor, the sensor stator configured to conduct the second magnetic field to produce a second voltage waveform signal; and a second controller communicatively coupled to the sensor stator, the second controller configured to:

receive the second voltage waveform signal from the sensor stator; and determine an operating characteristic of the motor based on the received second voltage waveform signal.

* * * * *